United States Patent [19]

Spielman

[11] 3,941,270

[45] Mar. 2, 1976

[54] REMOVABLE SEAL FOR LIQUID CONTAINERS

[75] Inventor: Burton A. Spielman, Chatham, N.J.

[73] Assignee: Allied Chemical Corporation, New York, N.Y.

[22] Filed: Jan. 25, 1974

[21] Appl. No.: 436,766

[52] U.S. Cl. ..... 215/261; 215/276; 141/350

[51] Int. Cl.[2] ..... B65D 51/16

[58] Field of Search ..... 141/319, 321, 350; 222/541; 220/27, 265, 44 A, 44 C; 215/250, 276, 261, 56; 138/45

[56] References Cited

UNITED STATES PATENTS

| | | | |
|---|---|---|---|
| 650,429 | 5/1900 | Smith | 220/27 |
| 978,712 | 12/1910 | Drenk | 215/250 |
| 1,777,736 | 10/1930 | Salz | 220/27 |

*Primary Examiner*—Houston S. Bell, Jr.

*Attorney, Agent, or Firm*—Anthony J. Stewart; Jay P. Friedenson

[57] ABSTRACT

A removable seal for a liquid container comprising a flexible liquid impervious sealing member for sealing an end of the container which sealing member is held against the end by a screw closure having a perforate top wall so that application of pressure upon the sealing member through the top wall disengages the sealing member.

7 Claims, 5 Drawing Figures

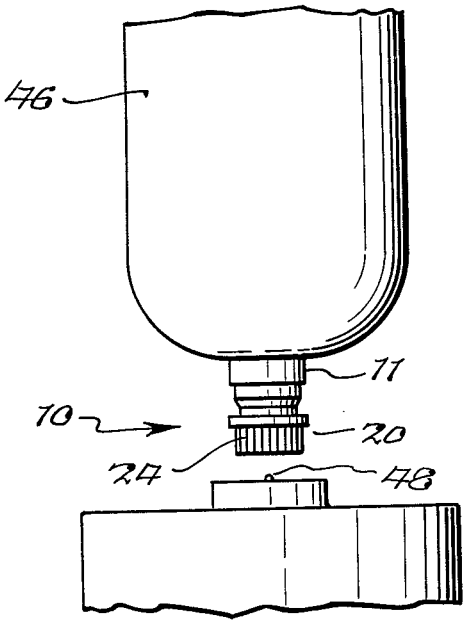
Fig. 1.
Fig. 5.
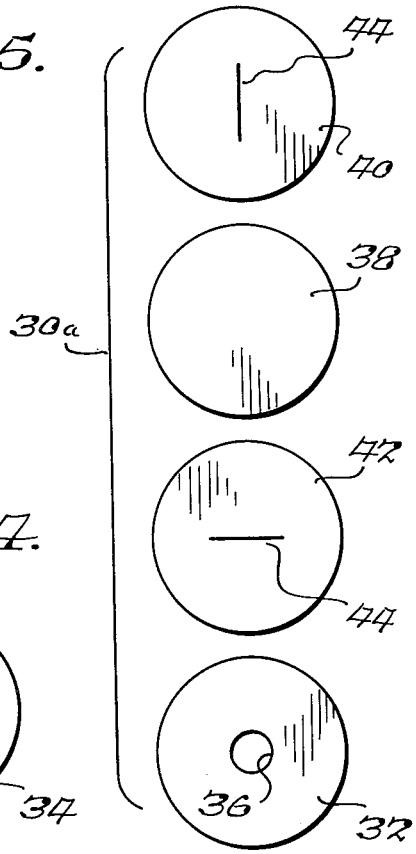
Fig. 4.
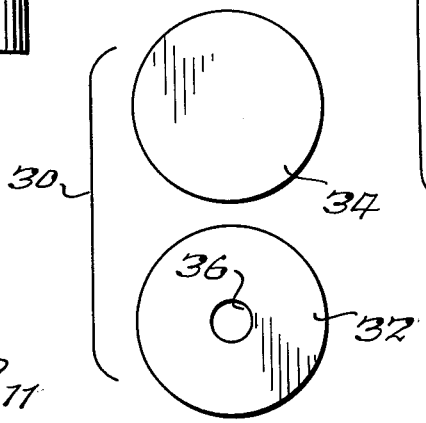
Fig. 2.
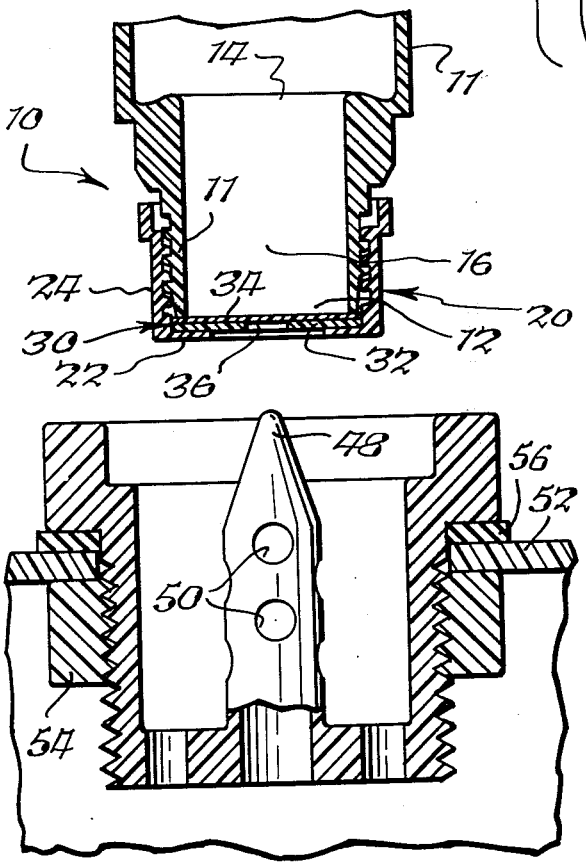
Fig. 3.
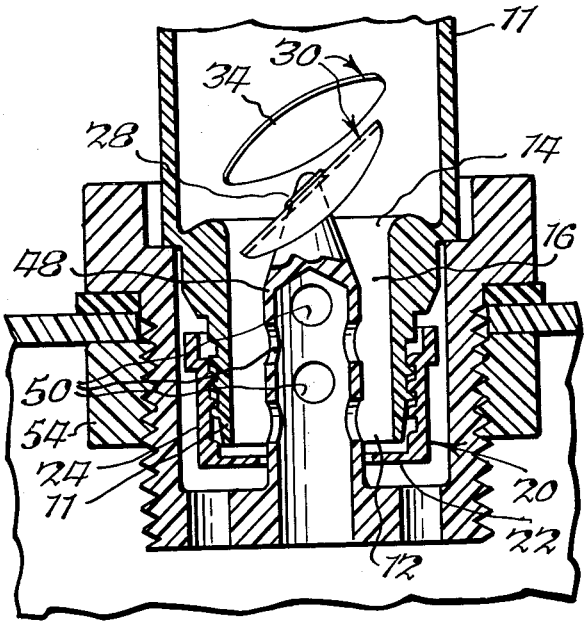

REMOVABLE SEAL FOR LIQUID CONTAINERS

BACKGROUND OF THE INVENTION

This invention relates to a seal for liquid materials and more particularly relates to seals of the type which are broken by any suitable puncturing device. In the prior art seals which were broken by puncturing devices resulted in a hole in the seal which permitted liquid to flow through the hole to the exterior of the container or conduit to which the seal was applied. A serious disadvantage of this type of prior art seal is that the act of puncturing the seal results in a raised portion inside the container seal surrounding the position of the puncture. The raised portion results in a wall or dam which will hold liquid thus preventing all of the liquid from flowing through the hole in the punctured seal. This residual liquid creates a serious problem, particularly when the liquid is corrosive in nature in that when the flow of liquid through the hole in the seal stops and the container, e.g. bottles, conduits or other liquid storing or carrying devices, to which the seal is applied is moved or shaken the residual liquid held by the raised portion surrounding the location of the puncture can flow over the raised portion and through the puncture to the exterior of the seal. Since such flow of the residual liquid only occurs when the container is moved, such flow usually occurs at an undesirable time and location e.g. when an empty container for liquid is removed from the location where the liquid is poured from the container into a desired reservoir.

BRIEF DESCRIPTION OF THE DRAWINGS

FIG. 1 is a view of an inverted container showing a removable seal which is in a position above a puncturing device.

FIG. 2 is a cross sectional view of a seal of the invention which is in a position above a puncturing device;

FIG. 3 is a cross sectional view showing a seal of the invention being removed by a puncturing device;

FIG. 4 is a top view of the components of a sealing member which forms a part of the removable seal of the invention; and FIG. 5 is a top view of the components of an alternative embodiment of a sealing member of the removable seal of the invention.

BRIEF DESCRIPTION OF THE INVENTION

In accordance with this invention a removable seal for liquid containers is provided which is removed by a puncturing device without forming a raised portion around the position of the puncture which will retain liquids. Rather than providing a sealing member which is punctured, such as the sealing members known in the prior art, the sealing member of this invention is completely removed by the puncturing device resulting in no raised portion.

The removable seal for liquid containers of this invention comprises a cylindrical member having first and second open ends, an internal hollow portion and an external male thread proximate its first end. The removable seal further comprises a screw closure comprising a top wall and a continuous side wall, the side wall being attached to and extending from the edge of the top wall. The side wall is internally provided with a female thread for engagement with the male thread of the cylindrical hollow member and the top wall has a perforate portion which permits communication through the top wall.

A flexible liquid impervious sealing member for engagement with and for sealing the first end of the cylindrical hollow member is held against the first end by the top wall of the screw closure. When pressure is applied upon the sealing member through the perforate portion of the top wall, the sealing member disengages from the first end of the cylindrical hollow member thus permitting communication through the perforate portion of the top wall to the hollow portion of the cylindrical member. In accordance with this invention the sealing member is completely removed from the first end of the cylindrical hollow member and the sealing member is desirably manufactured from a material which is less dense than the liquid which passes through the top wall so that when the seal is in an inverted position the flexible member will float away from the perforate portion of the top wall so that the sealing member will not interfere with the flow of liquid through the perforate portion of the top wall.

PREFERRED EMBODIMENT OF THE INVENTION

In accordance with the preferred embodiment of this invention the second end of the cylindrical member communicates with a container for a liquid so that the container can be inverted and placed on a puncture mechanism to remove the liquid impervious sealing member thus permitting liquid to flow from the container through the perforate portion of the top wall to a desired location.

Additionally, in accordance with the preferred embodiment of this invention, the flexible liquid impervious sealing member comprises first and second adjacent flexible discs. The first disc is provided with a centrally located circular perforation and the second disc is imperforate and covers the circular perforation in the first disc. The circular perforation in the first disc is provided so that the tip of the puncture mechanism will engage the perforation and carry the first disc and adjacent second disc away from the top wall of the screw closure so that after the discs are removed they will not interfere with flow of liquid from the container through the perforate portion of the top wall.

In general the first disc provides support for the second disc and therefore may be less flexible than the second disc. The second disc may be gas permeable so that if the liquid in the container produces gas upon exposure to heat or light the gas will pass through the second disc. In an alternative embodiment of the invention when the second disc is a thin gas permeable disc it is disposed between third and fourth discs which are provided for structural support of the second disc. In the preferred embodiment the third and fourth discs are each provided with centrally located slits, the third disc being in contact with the first end of the cylindrical member and the fourth disc being disposed between the first and second discs.

In general when the second disc is gas permeable it has a thickness between about 0.0005 and 0.005 inch. The gas permeable second disc may be manufactured from any suitable material such as gas permeable thermoplastic polymers. Each of the third and fourth discs, when provided, in the preferred embodiment have a thickness between about 0.015 and 0.025 inch and each of the slits in the third and fourth discs is between about 0.05 and 0.3 inch in length. The first disc which in the preferred embodiment is used to assist in forcing the remaining discs from the first end of the cylindrical hollow member, generally has a thickness of from about 0.05 and 0.01 inch. The first disc generally has a thickness of about 0.032 inch.

As seen in the drawings the removable seal 10 in accordance with the preferred embodiment of this invention comprises a cylindrical member 11 having first open end 12 and second open end 14, an internal hollow portion 16 and external male thread 18 proximate first open end 12. The removable seal 10 further comprises a screw closure 20 having a top wall 22 and a continuous side wall 24 which is attached to and extends from top wall 22. Side wall 24 is internally provided with a female thread 26 for engagement with male thread 18 of cylindrical member 11. Top wall 22 is provided with a perforate portion 28 permitting communication through top wall 22 to a flexible liquid impervious sealing member 30 or 30a. Particular preferred embodiments of the flexible liquid impervious sealing member 30 or 30a are shown in FIGS. 4 and 5. The first embodiment of the flexible liquid impervious sealing member 30 shown in FIG. 4 is a liquid tight seal comprising first and second adjacent flexible discs 32 and 34, first adjacent disc 34 being provided with a centrally located perforation 36 and second adjacent disc being imperforate and covering perforation 36 in first disc 32.

FIG. 5 shows an alternative embodiment of flexible liquid impervious sealing member 30a which embodiment will permit passage of gas through the seal but will prevent passage of liquid through the seal. Flexible liquid impervious sealing member 30a comprises first disc 32, a second disc 38 and third and fourth discs 40 and 42. Disc 38 is gas permeable and generally has a thickness between about 0.0005 and 0.005 inch. Third and fourth discs 40 and 42 are provided to support gas permeable second disc 38 and are disposed on opposing sides of disc 38 to provide such support. Each of discs 40 and 42 is provided with a slit 44. Each slit 44 has a length of between about 0.005 and 0.3 inch. The supporting third and fourth discs 40 and 42 generally have a thickness between about 0.015 and 0.025 inch. Flexible liquid impervious sealing member 30, or **30*a* is held against first open end 12 of cylindrical member 11 by top wall 22 of screw closure 20 thus sealing first end 12. In the preferred embodiment of the invention second open end 14 of cylindrical member 11 integrally communicates with a liquid container 46**.

In operation sealing member 30 or 30a may be removed from first open end 12 by applying pressure upon sealing member 30 or **30*a* through perforate portion 28 of top wall 22. When such pressure is applied sealing member 30 or 30*a* disengages from first end 12 of cylindrical member 11 thus permitting communication through perforate portion 28 of top wall 22 to hollow portion 16 of cylindrical member 11**.

The pressure may be applied through perforate portion 28 of top wall 22 by any suitable means. For example a hollow spike 48 can be used which is provided with openings 50 to permit entry of liquid from hollow portion 16 into hollow spike 48 for carrying the liquid through hollow spike 48 to any desired location. The use of hollow spike 48 to remove sealing member 30 or **30*a* is best seen in FIGS. 2 and 3. As seen in FIG. 3, when sealing member 30 is removed from first open end 12, it is carried by hollow spike 48 away from first open end 12 so that sealing member 30 will not obstruct the flow of liquid from hollow portion 16 through open end 12 or into hollow spike 48**.

Hollow spike 48 may be conveniently attached to a supporting surface 52 by means of nut 54 and gasket 56.

I claim:

1. A removable seal for liquid containers comprising:

a cylindrical member having first and second open ends, an internal hollow portion and an external male thread proximate the first end thereof;

a screw closure comprising a top wall and a continuous side wall, said side wall being attached to and extending from the edges of said top wall, said side wall being internally provided with a female thread for engagement with the male thread of said cylindrical hollow member said top wall having a perforate portion permitting communication through the top wall;

a flexible liquid impervious sealing member for engagement with and for sealing the first end of the cylindrical hollow member, said flexible member being held against said first end by the top wall of the screw closure, permitting disengagement of the sealing member from the first end of the cylindrical hollow member by application of pressure upon the sealing member through the perforate portion of the top wall.

2. The removable seal of claim 1 wherein the second end of the cylindrical member communicates with a container for liquid.

3. The removable seal of claim 2 wherein the flexible liquid impervious sealing member comprises first and second adjacent flexible discs the first disc being provided with a centrally located circular perforation and the second disc being imperforate, and covering the circular perforation in the first disc.

4. The removable seal of claim 3 wherein the second disc is more flexible than the first disc.

5. The removable seal of claim 4 wherein the second disc is gas permeable.

6. The removable seal of claim 5 wherein third and fourth discs are provided for structural support of the second disc, said third and fourth discs each being provided with centrally located slits said third disc being in contact with the first end of the cylindrical member and the fourth disc being disposed between the first and second discs.

7. The removable seal of claim 6 wherein the gas permeable second disc has a thickness between about 0.0005 and 0.005 inch and each of the third and fourth discs have a thickness between about 0.015 and 0.025 inch, each of the slits in the third and fourth discs being between about 0.05 and 0.3 inch in length.

* * * * *